US011548718B1

(12) United States Patent
Florez

(10) Patent No.: US 11,548,718 B1
(45) Date of Patent: Jan. 10, 2023

(54) INSULATED CONTAINER HAVING AN INTERNAL GEL LAYER AND A VACUUM INSULATE LAYER

(71) Applicant: Sophia Investments Inc., Plantation, FL (US)

(72) Inventor: Otoniel Florez, Plantation, FL (US)

( * ) Notice: Subject to any disclaimer, the term of this patent is extended or adjusted under 35 U.S.C. 154(b) by 0 days.

(21) Appl. No.: 17/129,403

(22) Filed: Dec. 21, 2020

Related U.S. Application Data

(60) Provisional application No. 62/950,273, filed on Dec. 19, 2019.

(51) Int. Cl.
*B65D 81/38* (2006.01)
*A47G 19/22* (2006.01)
*A47G 23/02* (2006.01)

(52) U.S. Cl.
CPC ..... *B65D 81/3886* (2013.01); *A47G 19/2205* (2013.01); *A47G 19/2288* (2013.01); *A47G 23/0241* (2013.01); *B65D 81/3881* (2013.01); *B65D 81/3883* (2013.01); *A47G 2023/0275* (2013.01)

(58) Field of Classification Search
CPC ..... B65D 81/3869; B65D 81/3872; B65D 81/3874; B65D 81/3881; B65D 81/3886; B65D 81/3883; A47G 19/2205; A47G 19/2288; A47J 41/0072; A47J 41/0077
See application file for complete search history.

(56) References Cited

U.S. PATENT DOCUMENTS

| | | | | |
|---|---|---|---|---|
| 1,191,319 | A * | 7/1916 | Kline | F25D 3/08 220/592.16 |
| 2,926,508 | A * | 3/1960 | Moon | A47G 19/2288 62/457.3 |
| 3,205,677 | A * | 9/1965 | Stoner | A47G 19/2288 62/457.3 |
| 4,163,374 | A | 8/1979 | Moore | |
| 4,768,354 | A | 9/1988 | Barnwell | |
| 5,934,099 | A * | 8/1999 | Cook | A61J 1/165 62/457.2 |
| 9,181,015 | B2 * | 11/2015 | Booska | A47G 19/2266 |
| 10,370,171 | B1 * | 8/2019 | Krenz | G01F 23/292 |
| 10,549,902 | B1 * | 2/2020 | Brown, II | A47G 19/2255 |
| 2009/0045194 | A1 * | 2/2009 | Rhee | B65D 81/3881 220/23.89 |

* cited by examiner

*Primary Examiner* — Don M Anderson
*Assistant Examiner* — Jennifer Castriotta
(74) *Attorney, Agent, or Firm* — Sanchelima & Associates, P.A.; Christian Sanchelima; Jesus Sanchelima

(57) ABSTRACT

An insulated container including a container assembly and a gel assembly. The container includes a first sleeve, second sleeve, and outer sidewall. The container includes a cavity to receive a beverage therein. The second sleeve extends about the outer circumference of the first sleeve. A spacing is defined between the first sleeve and the second sleeve. A gel layer of the gel assembly is received within the spacing. The gel layer, when the container is cooled, is cooled and provides cold energy to the beverage held within the container. Between the second sleeve and the outer sidewall exists a vacuum spacing. The vacuum spacing provides vacuum insulation to ensure that heat does not reach the first sleeve through direct contact when being cooled by the gel layer. Allowing the beverage to be cooled for extended periods of time within the insulated container.

1 Claim, 4 Drawing Sheets

INSULATED CONTAINER HAVING AN INTERNAL GEL LAYER AND A VACUUM INSULATE LAYER

BACKGROUND OF THE INVENTION

1. Field of the Invention.

The present invention relates to an insulated container and, more particularly, to an insulated container using vacuum insulation and a gel layer to maintain a desired temperature within the container for extended lengths of time.

2. Description of the Related Art.

Several designs for insulated containers have been designed in the past. None of them, however, include a container combining vacuum insulation and a refrigerant gel layer to help maintain a drink held within the container at a desired cold or hot temperature for predetermined lengths of time. It is known that individuals have a need to maintain beverages at a desired temperature once they have been removed from storage or original containers. If not kept in an insulated container, the beverage may quickly grow warm and thereby reduces the satisfaction of the user drinking the beverage. Therefore, there is a need for an insulated container to maintain the cold temperature of the beverage. Several insulated cups have been designed, however, the lack the novelty of the vacuum insulation used in combination with a gel layer in between the container for superior insulation and temperature regulation.

Applicant believes that a related reference corresponds to U.S. Pat. No. 4,163,374 for a refrigerable beverage container holder having means for insulating and chilling a canned beverage such as beer or soft drink including a cylindrical cup-shaped liner structure disposed within a conventional foam beverage can holder. Applicant believes another related reference corresponds to U.S. Pat. No. 4,768,354 for a heat treatment cup for a beverage container that is a temperature influencing receptacle for receiving a beverage container. The receptacle comprises an outer insulating cover and an inner insert held within the insulating cover. None of these references, however, teach of a container that is able of providing insulation with the combination of vacuum insulation and a gel layer within to maintain a beverage held within the container at a desired cold or hot temperature for an extended predetermined period of time.

Other documents describing the closest subject matter provide for a number of more or less complicated features that fail to solve the problem in an efficient and economical way. None of these patents suggest the novel features of the present invention.

SUMMARY OF THE INVENTION

It is one of the objects of the present invention to provide an insulated container that preserves the temperature, whether hot or cold, of beverages held within for a predetermined length of time.

It is another object of this invention to provide an insulated container combining vacuum insulation and a gel layer for superior insulation to maintain the beverage within the container at a desired temperature.

It is still another object of the present invention to provide an insulated container that may be easily transportable and fits within cup holder receptacles.

It is also another object of the present invention to provide an insulated container that can cool a beverage held within rapidly.

It is yet another object of this invention to provide such a device that is inexpensive to implement and maintain while retaining its effectiveness.

Further objects of the invention will be brought out in the following part of the specification, wherein detailed description is for the purpose of fully disclosing the invention without placing limitations thereon.

BRIEF DESCRIPTION OF THE DRAWINGS

With the above and other related objects in view, the invention consists in the details of construction and combination of parts as will be more fully understood from the following description, when read in conjunction with the accompanying drawings in which.

DETAILED DESCRIPTION OF THE EMBODIMENTS OF THE INVENTION

Figure 1:
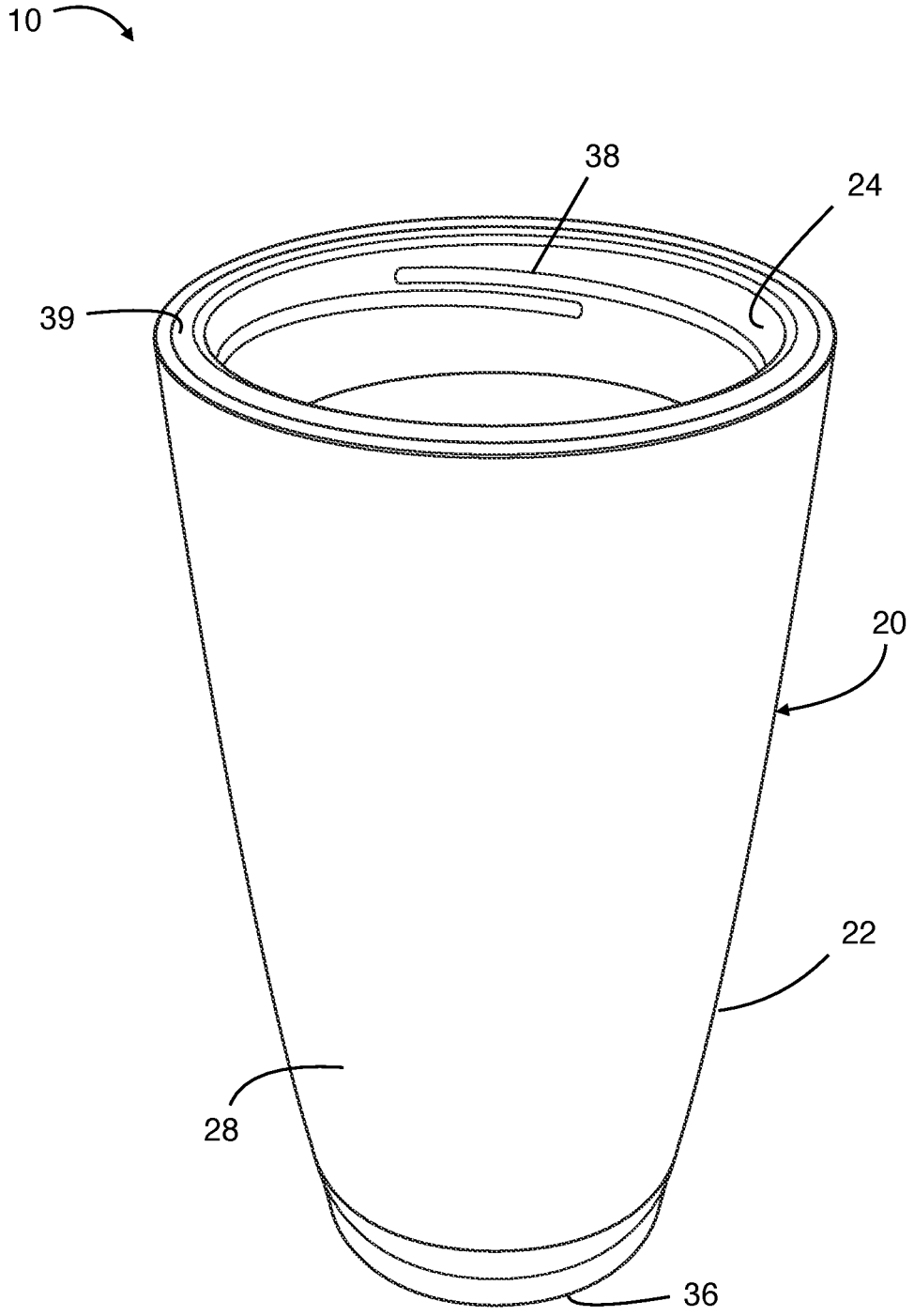
FIG. 1 represents an elevated isometric view of insulated container 10 in accordance with an embodiment of the present invention.
Figure 2:
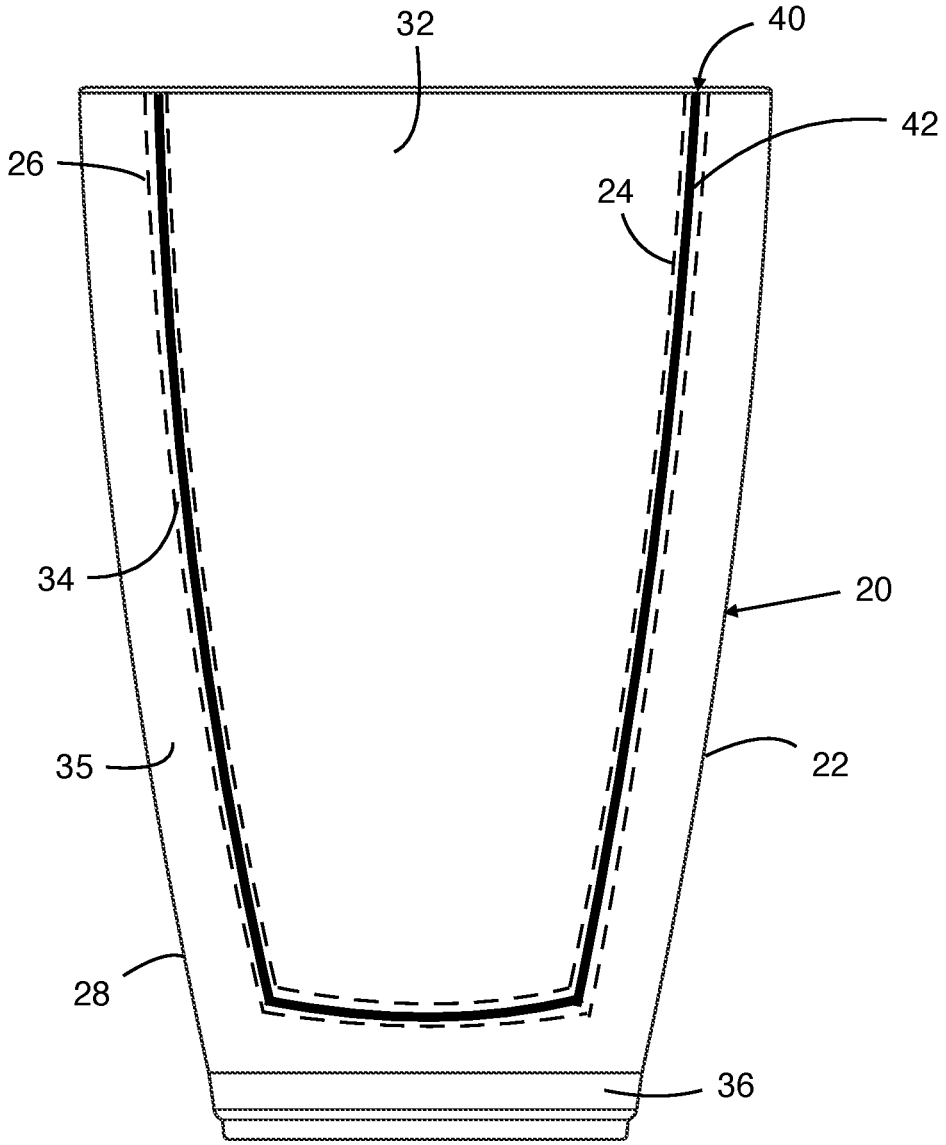
FIG. 2 shows a side view of insulated container 10 in accordance with an embodiment of the present invention.
Figure 3:
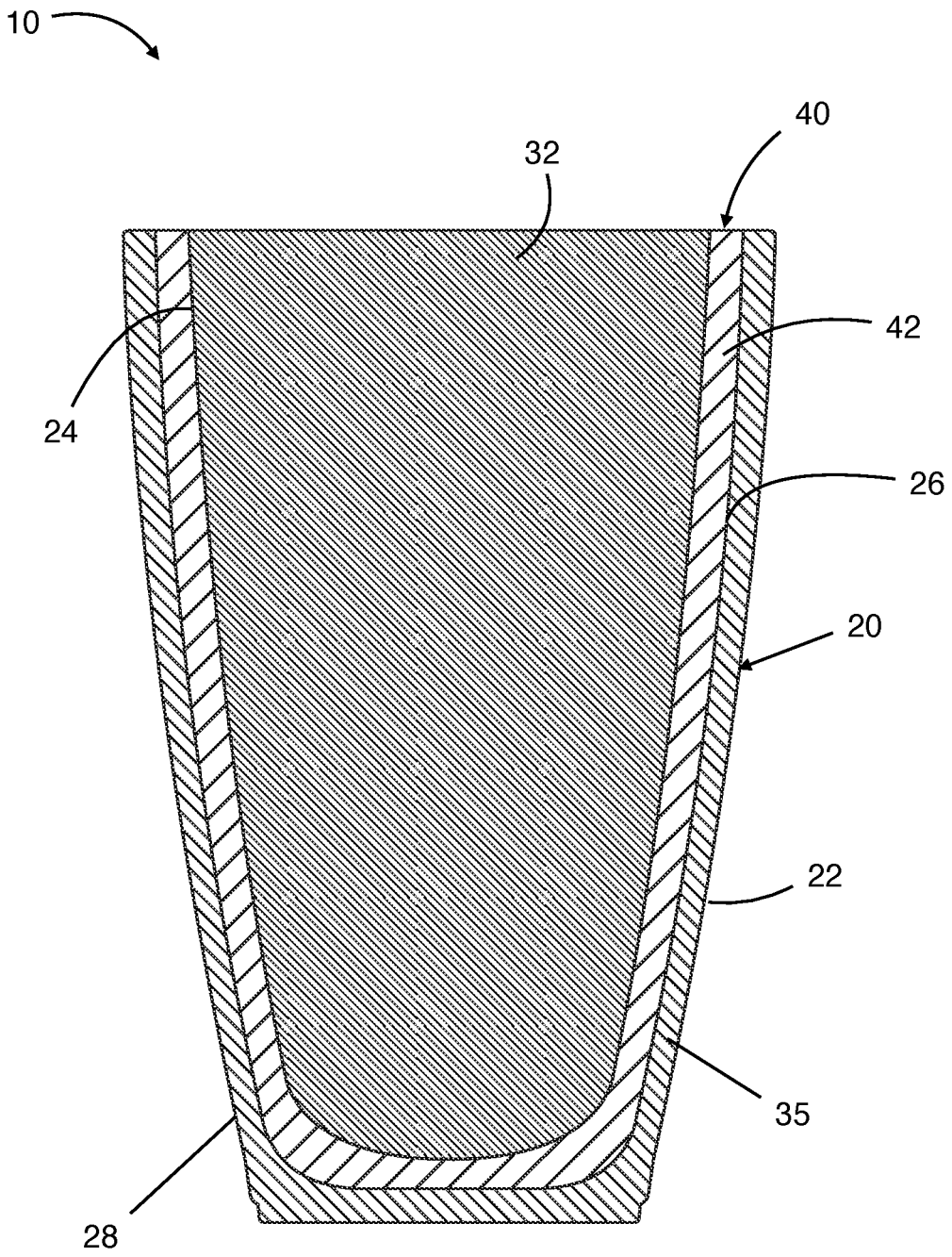
FIG. 3 is a representation of a cross-sectional view of insulated container 10 depicting gel assembly 40 within container assembly 20.
Figure 4:
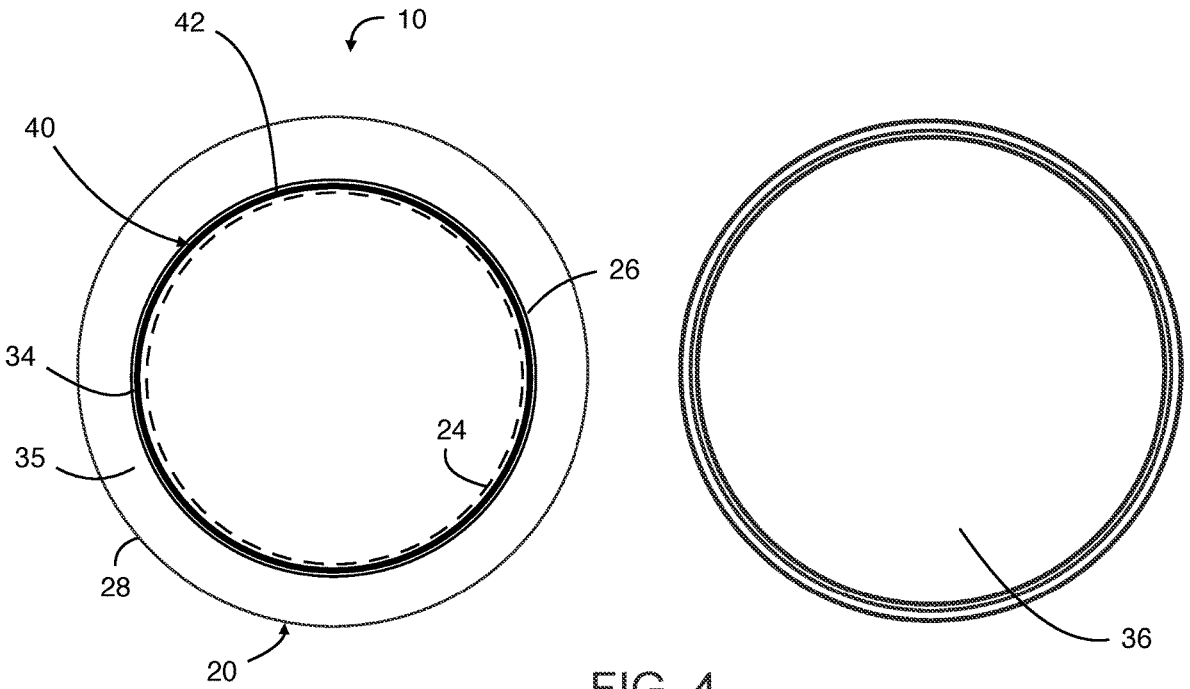
FIG. 4 illustrates a bottom view of insulated container 10 with the bottom cover juxtaposed to the bottom of the container.
Figure 5:
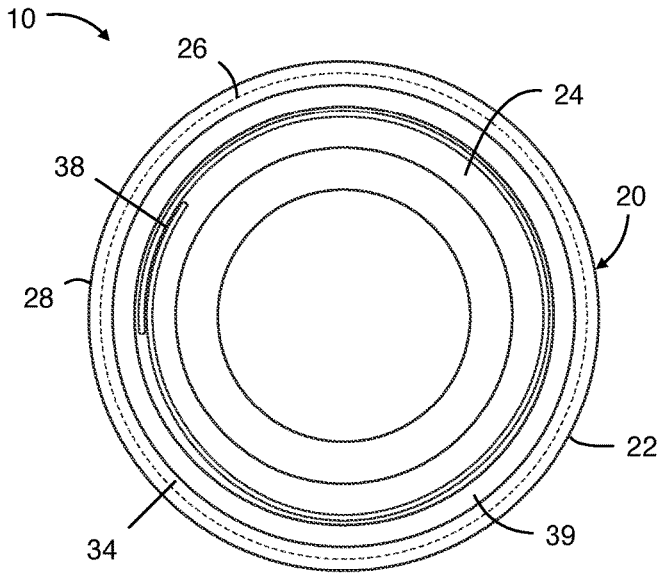
FIG. 5 represents a top view of insulated container 10, in accordance with an embodiment of the present invention.

Referring now to the drawings, where the present invention is generally referred to with numeral 10, it can be observed an insulated container 10 that includes a container assembly 20 and a gel assembly 40 is disclosed.

Insulated container 10 may insulate to be able to maintain the temperate of a beverage held within at a desired temperature for extended periods of time. Preferably, insulated container 10 may help to maintain the beverage cold. However, it may be suitable for insulated container 10 to maintain the beverage within cold or hot as desired by the user. Advantageously, insulated container 10 may help to expedite the cooling of the beverage within. Allowing users to more quickly enjoy cold beverages.

Container assembly 20 may include a container 22. In one embodiment, container 22 may be made of materials such as aluminum, metal, stainless steel, plastic, rubber, or other suitable materials. Container 22 may have a cylindrical configuration in the preferred embodiment. It may be suitable for container 22 to be tapered in one implementation. It is to be understood that container 22 may be defined by a first sleeve 24, a second sleeve 26, and an outer sidewall 28. In one embodiment, first sleeve 24, second sleeve 26, and outer sidewall 28 may be tapered. With first sleeve 24 and second sleeve 26 within container 22 substantially away from outer sidewall 28. Outer sidewall 28 may extend about the entire circumference of container 22. In an alternate embodiment, container 22 may be selectively covered or sealed with a lid.

Importantly, secured within container 22 may be a first sleeve 24. It is to be understood that first sleeve 24 may have a substantially U-shaped configuration. First sleeve 24 may be centrally located within container 22. It may be suitable to secure first sleeve 24 within container with an adhesive, in one embodiment. It is to be understood that entirely about an upper circumference of first sleeve 24 may be a lip 39. Lip 39 may extend outwardly and away from first sleeve 24 in a perpendicular manner. Lip 39 may help to secure first sleeve 24 to outer sidewall 28 and within container 22. Lip 39 may, additionally, facilitate consuming of beverages from container 22 in a comfortable manner due to its smoothness along a top surface thereof. It may be suitable for first sleeve 24 to be integral with container 22, in an alternate embodiment. As first sleeve 24 is secured within container 22, first sleeve 24 may include a diameter and a circumference less than a diameter and a circumference of container 22. Additionally, first sleeve 24 may have a shorter or equal length than that of container 22. It is to be understood that first sleeve 24 may be substantially away from outer sidewall 28 of container 22.

First sleeve 24 may include a cavity 32 located within first sleeve 24. Cavity 32 may lead to an interior of container 22. Cavity 32 may extend the entire length of first sleeve 24. Within cavity 32, the desired beverage is held by container 22. It may also be suitable to hold a bottle, with a drink within, inside of cavity 32 as well. It is to be understood that cavity 32 may preferably have a length less than that of container 22. Container 22 may have an open-top face permitting cavity 32 to be readily and constantly accessible. In an alternate embodiment, cavity 32 may be selectively covered with a container lid. As such, first sleeve 24 may include threads 38 located at an upper inner portion of first sleeve 24. More specifically, threads 38 may extend entirely along an inner circumference of first sleeve 24. Threads 38 may allow for accessories to engage and cooperate with container 22. In one embodiment, threads 38 may secure a container cover or a neck portion to container 22, for example. Threads 38 may permit for accessories, such as lids or covers, to be removably secured to container 22.

Notably, within container 22 may also be second sleeve 26. It is to be understood that second sleeve 26 may have a substantially U-shaped configuration. It may be suitable for first sleeve 24 and second sleeve 26 to be substantially similar in structure. Second sleeve 26 may preferably be made of similar materials as first sleeve 24. It is to be understood that second sleeve 26 may entirely surround first sleeve 24 along the entire circumference of first sleeve 24 within container 22. It may be suitable for second sleeve 26 to be located beneath first sleeve 24. It is to be noted that second sleeve 26 may have dimensions greater than those of first sleeve 24. It may be suitable for a length and a diameter of second sleeve 26 to be greater than the length and the diameter of first sleeve 24, respectively. It is to be understood that first sleeve 24 and second sleeve 26 may be secured within container 22 with the use of a gel-like substance that secured first sleeve 24 and second sleeve 26 to a top of container 22.

It is to be understood that between the outer circumference of first sleeve 24 and the inner circumference of second sleeve 26 may be defined a spacing 34 within container 22. Spacing 34 may be defined entirely as the area existing between first sleeve 24 and second sleeve 26. Spacing 34 may entirely surround first sleeve 24. Vitally, within spacing 34 may be received gel assembly 40. Gel assembly 40 may be received through a top end of spacing 34, preferably. Preferably, gel assembly 40 may fill spacing 34 entirely. Thereby, allowing for container 22 to insulate properly as needed. In one embodiment, the size of spacing 34 may be greater than a thickness of both first sleeve 24 and second sleeve 26 combined.

Insulated container 10 may further include a vacuum spacing 35. Vacuum spacing 35 may be defined as the distance between the outer circumference of second sleeve 26 and the inner circumference of outer sidewall 32. Within vacuum spacing 35 may be air. Vacuum spacing 35 may assist container 22 in achieving vacuum insulation. Container 22 may be sealed with a bottom cover 36 at a bottom distal end thereof. Bottom cover 36 may be fixedly secured to the outer sidewall. Thereby sealing the air within vacuum spacing 35. Vacuum insulation may assist in maintaining beverages within container 22 at desired temperatures for extended periods of time. Vacuum insulation helps to prevent heat to dissipate through means of conduction within container 22 and towards the beverage held therein. That is, cold beverages may remain cold, while hot beverages may remain hot when held within container 22. The vacuum insulation provided by vacuum spacing further aids insulated container 10 in achieving insulation for the beverage within. It is to be understood that spacing 34 and vacuum spacing 35 may be adjusted in size to aid in providing added insulation to maintain beverages within container 22 cold for even longer extended periods of time. In one embodiment, the vacuum spacing 35 has a thickness of $^1/_4$ inches. However, other embodiments may include vacuum spacing 35 with a thickness greater or less than this range.

Spacing 34 may receive gel assembly 40 within. Gel assembly 40 may be inserted into spacing 34 through a top of container 22. Gel assembly 40 may further aid insulated container 10 in maintaining a predetermined temperature of the beverage within container 22. Additionally, gel assembly 40 may cool beverages received within container 22. Gel assembly 40 may include a gel layer 42. Gel layer 42 may be a refrigerant gel having a predetermined thickness, viscosity, and consistency. Gel layer 42 may be made of various combinations. Some combinations may include water, a thickening agent, silica gel, propylene glycol, gel beads, sodium polyacrylate, or other suitable materials. It may be necessary to cool or freeze insulated container 10 before usage when insulated container 10 is used to cool beverages. Thereby allowing for gel layer 42 to cool and harden. Subsequently, allowing for gel layer 42 to release coldness towards first sleeve 24 and the beverage received within cavity 32. It is to be understood that gel layer 42 may entirely surround first sleeve 24 about the outer circumference of first sleeve 24. Gel layer 42 may be in constant abutting contact with first sleeve 24 to be able to transfer cold energy from gel layer 42 to first sleeve 24 through conduction or direct contact. Subsequently resulting in the cold energy of gel layer 42 being transferred towards the beverage held within cavity 32 to cool or maintain cold the beverage. It is to be understood that when insulated container 10 is used to maintain beverages warm, then container 22 is not frozen before usage to avoid gel layer 42 becoming cold. As such, gel layer 42 is selectively cooled depending on whether the beverage within container 22 is to be maintained cold or hot. Gel layer 32 may have a freezing point lower than 32 degrees Fahrenheit. In one embodiment, gel layer 42 has a thickness of $^1/_4$ inches. The thickness may vary and include a range greater than or less than $^1/_4$ inches.

Insulated container 10 may use gel layer 42 to cool beverage within cavity 32. While the vacuum insulation of the present invention created in vacuum spacing 35 may help to reduce heat reaching the cooled beverage within container 22. This combination helps to provide better a better experience for users as the temperature of the beverage is preserved at the desired temperature for extend lengths of time.

The foregoing description conveys the best understanding of the objectives and advantages of the present invention. Different embodiments may be made of the inventive concept of this invention. It is to be understood that all matter disclosed herein is to be interpreted merely as illustrative, and not in a limiting sense.

What is claimed is:

1. An insulated container, consisting of: a. a container assembly including a container having a first sleeve and a second sleeve therein, a spacing is defined between an outer circumference of the first sleeve and an inner circumference of said second sleeve, said first sleeve has a completely open-top face that cooperates with receiving bottles, said first sleeve has a bottommost end which is U-shaped, the container assembly further includes a thread located on said first sleeve proximal to said open-top face, said thread follows a helical trajectory, said thread having 1 spiral, said container includes an outer sidewall extending about the entire circumference of said container, said second sleeve has a length greater than a length of the first sleeve; and b. a gel assembly including a gel layer, said gel layer received within said spacing and enveloping the first sleeve, said gel layer cooling a beverage received within said container when cooled, said container further including a vacuum insulate layer between said second sleeve and an inner surface of a sidewall of the container, said vacuum insulate layer entirely envelops the gel layer and extends below a bottom end of the gel layer, said vacuum insulate layer is sealed with a bottom cover attached to a bottom of said container, said vacuum insulate layer providing vacuum insulation, said gel layer has a freezing point lower than 32 degrees Fahrenheit, said gel is selectively frozen, said gel layer is in constant abutting contact with the first sleeve.

* * * * *